United States Patent [19]

Roccaforte

[11] 4,320,830

[45] Mar. 23, 1982

[54] CARTON HAVING PIVOTABLE PLATFORM

[75] Inventor: Harry I. Roccaforte, Western Springs, Ill.

[73] Assignee: Champion International Corporation, Stamford, Conn.

[21] Appl. No.: 131,082

[22] Filed: Mar. 17, 1980

[51] Int. Cl.[3] ..... B65D 5/50

[52] U.S. Cl. ..... 206/45.19; 229/16 R

[58] Field of Search ..... 206/45.19, 45.14; 229/15, 16 R, 34 HW

[56] References Cited

U.S. PATENT DOCUMENTS

| | | | |
|---|---|---|---|
| 2,620,962 | 12/1952 | Parnell | 206/45.19 |
| 2,681,174 | 6/1954 | Bergstein | 229/34 HW |
| 2,993,587 | 7/1961 | Stone | 206/45.19 |
| 3,095,086 | 6/1963 | Berg | 206/45.19 |
| 3,246,738 | 4/1966 | Weiss | 206/45.19 |
| 3,746,156 | 7/1973 | Austin | 206/45.14 |
| 4,108,348 | 8/1978 | Partain | 229/15 |
| 4,155,501 | 5/1979 | Young | 229/15 |

*Primary Examiner*—Herbert F. Ross

*Attorney, Agent, or Firm*—Evelyn M. Sommer

[57] ABSTRACT

A carton having a plurality of sidewalls forming a rectangular tube includes a transversely extending platform therewithin spaced from one end of the carton. The platform is hingedly joined along one lower edge of a sidewall by a triangularly shaped connecting tab specially cut to allow pivoting of the platform 180° relative to the sidewall to which it is joined. Printing is applied to only one side of the one piece blank from which the carton is formed, and the platform is pivoted during folding of the blank to dispose the printed side of the platform facing upwardly to be viewed through a display opening in one of the sidewalls.

8 Claims, 8 Drawing Figures

CARTON HAVING PIVOTABLE PLATFORM

TECHNICAL FIELD

This invention generally relates to cartons formed from a unitary blank, and deals more particularly with a carton of the type having a platform disposed within the carton which is employed for supporting or displaying the contents of the carton in a particular manner.

BACKGROUND AND BRIEF DESCRIPTION OF THE INVENTION

The use of a transversely extending platform member within a tube shaped carton to provide support for a product within the carton is an art recognized concept. The platform is wholly disposed within the sidewalls of the carton and is typically spaced slightly from the bottom wall thereof in order to support the contents of the carton at an elevated position therewithin, and in some cases may include cut-outs or depressions therein into which portions of the contents may be inserted in order to maintain or stabilize the contents within the carton. This type of prior art carton may often include openings in the sidewalls thereof in order that the contents may be viewed for display purposes.

In the interest of manufacturing economy, cartons of the type discussed above are formed from unitary, one piece paperboard blanks. Because the platform within the carton can be viewed through the sidewalls thereof, various types of printing or graphics indicia are printed upon the upper surface of the platform adjacent a product supported thereby. Printed indicia are also applied to the exterior sidewalls of this type of carton in addition to the printing carried by the surface of the platform. In the past, because of the manner in which the blank is folded during erection of the carton, it was necessary to print the indicia for the platform on one side of the blank and to print the indicia for the exterior sidewalls on the opposite side of the blank. Thus, it was necessary to print both sides of the blank, frequently in separate printing operations.

It is therefore an important object of the present invention to provide a carton having an internal platform wherein both the exterior surfaces of the sidewalls as well as the upper surface of the platform are provided with printed indicia thereon, but wherein the printed indicia may be applied to only one side of the blank used to form the carton.

Another object of the invention is to provide a carton of the type described immediately above wherein the platform is hingedly joined to an edge of one of the sidewalls by a connecting tab which allows pivoting of the platform 180° relative to the sidewalls to which it is attached.

According to the present invention a carton having a plurality of sidewalls forming a rectangular tube having the opposite ends thereof enclosed includes a transversely extending platform within the carton spaced from one end of the carton. The platform is hingedly joined along one lower edge of a sidewall by means of a triangularly shaped connecting tab specially cut and configured to allow pivoting of the platform 180° relative to the sidewall to which it is joined. Printing is applied to only one side of a one piece blank from which the carton is formed, and the platform is pivoted during the folding of the blank to dispose the printed side of the platform facing upwardly in a position to be viewed through a display opening in one of the sidewalls.

DESCRIPTION OF THE DRAWINGS

In the drawings, which form an integral part of the specification and are to read in conjunction therewith, and in which like reference numerals are employed to designate like parts in the various views.

DETAILED DESCRIPTION OF THE INVENTION

Figure 1:
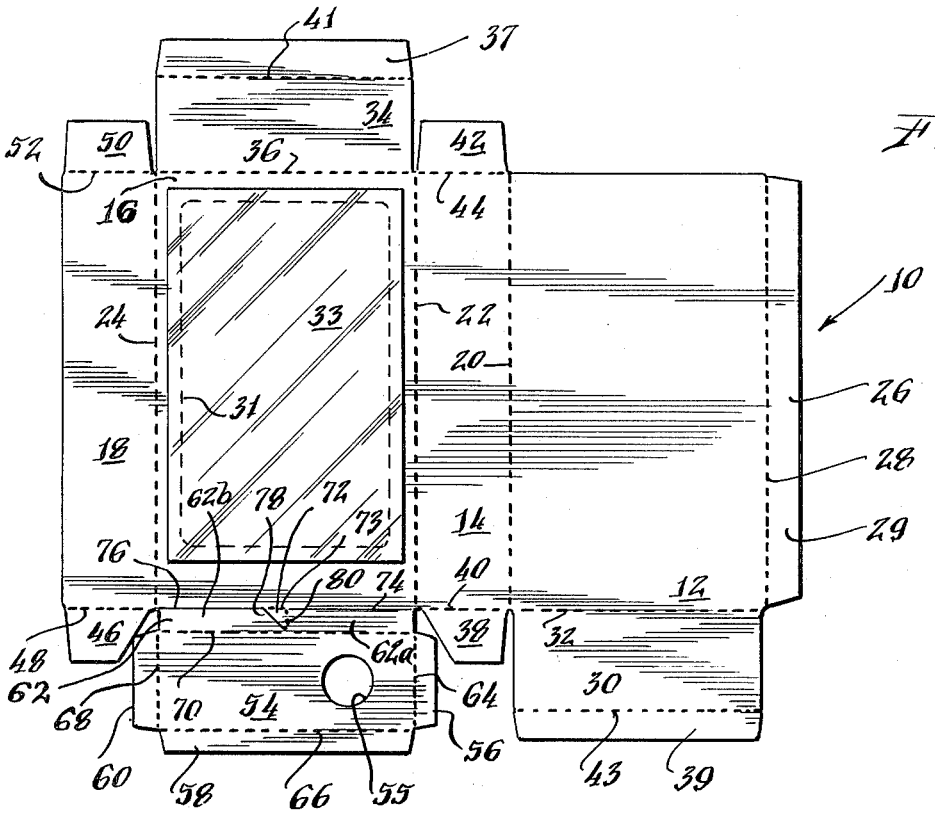
FIG. 1 is a plan view of a unitary blank which forms one aspect of the present invention.
Figure 2:
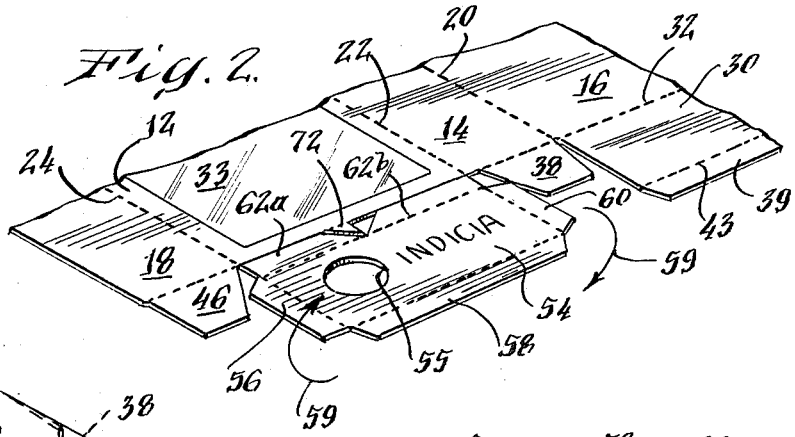
FIGS. 2–5 are a perspective views showing the various steps in folding the blank of FIG. 1 to form the carton of the present invention.
Figure 3:
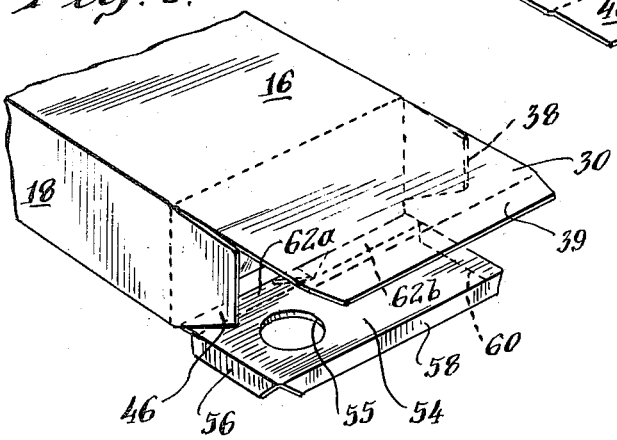

Referring first to FIG. 1, a novel blank generally indicated by the numeral 10 comprises a unitary sheet of paperboard cut and configured to present rectangularly shaped, sidewall forming panels 12, 14, 16 and 18 respectively hingedly connected along mutual edges by parallel fold lines 20, 22 and 24.

Sidewall panel 12 includes an elongate glue flap 26 hingedly connected along the outer edge thereof by fold line 28, which fold line 28 extends essentially parallel to the fold lines 20, 22 and 24. Glue flap 26 may be provided with an adhesive preapplied thereto as denoted by the glue strip 29. Sidewall panel 12 includes a rectangularly shaped cut-out 31 in the central region thereof. A sheet 33 of transparent plastic material, also of rectangular configuration, is superimposed over the cut-out 31 and is suitably attached as with the adhesive to the marginal areas of the sidewall panel 16 defining the cut-out 31.

Sidewall panel 16 is provided with a rectangularly shaped closure flap 30 hingedly connected to one edge thereof by the fold line 32, which later mentioned fold line extends essentially perpendicular to fold line 20. Sidewall panel 12 also is provided with a rectangularly shaped closure flap 34 hingedly connected to a upper edge thereof by fold line 36 which extends perpendicular to fold lines 22 and 24. Closure flaps 30 and 34 may be provided with locking flaps 37 and 39 respectively joined to the outer edges thereof by corresponding fold lines 41 and 43. Sidewall panel 14 includes a pair of closure flaps 38 and 42 respectively hingedly connected to the upper and lower edges thereof by the corresponding fold lines 40 and 44. Sidewall panel 18 likewise includes a pair of closure flaps 46 and 50 hingedly connected along the upper and lower edges thereof by the corresponding fold lines 48 and 52. Closure flaps 30 and 34 each possesses a longitudinal dimension essentially equal in length to the width of sidewall panels 12 and 16 respectively, while the lateral dimension of sidewall panels 30 and 34 are each essentially equivalent to the width of sidewall panels 14 and 18. Closure flaps 38 and 42 each have a length essentially equal to the width of sidewall panel 14, while the width of such closure flaps is considerably less than the like dimension of the corresponding closure flaps 30 and 34. Similarly, closure flaps 46 and 50 each possess a length dimension essentially indentical to the width of sidewall panel 18 while the lateral or width dimensions of closure flaps 46 and 50 are essentially identical to the like dimensions of closure flaps 38 and 42.

Sidewall panel 12 has a platform providing panel 54 novelly connected to the lower edge thereof, which platform panel 54 is disposed between closure flaps 38 and 46. Platform panel 54 is generally rectangular in shape and includes elongate flap members 56, 58, 60, and 62 respectively hingedly connected along the edges thereof by the corresponding fold lines 64, 66, 68, and 70.

Platform panel 54 is pivotably connected to sidewall panel 12 by means of a triangularly shaped connecting tab 72 which is defined within the flap member 62 and divides the latter into a first and second portion respectively designated by 62*a* and 62*b*. Portions 62*a* and 62*b* are respectively separated from the lower edge of sidewall panel 12 by the cut lines 74 and 76 which respectively extend from adjacent the fold lines 22 and 24 up to the connecting tab 72.

One edge of the connecting tab 72 is defined by a fold line 80 in the flap member 62 which extends perpendicularly from the fold line 70 to one end of the cut line 74. Another edge of the connecting tab 72 is defined by a cut line 78 which extends obliquely between the intersection of fold lines 70 and 80, and one end of the cut line 76. Finally, the remaining edge of the connecting tab 72 is defined by a fold line 73 extending between the adjacent ends of cut lines 74 and 76. In the preferred form of the invention, fold line 80 extends perpendicularly away from the cut lines 74 and 76 and is disposed centrally along the lower edge of sidewall panel 12.

Although not specifically shown in FIG. 1, the face of the blank 10 opposite the face onto which the sheet 33 is secured may be printed with various types of indicia as desired. More particularly, the indicia may be applied to the sidewall panels 12, 14, 16 and 18, as well as to the platform 54. A product receiving cut-out 55 of preselected geometry may be provided at a desired location in the platform panel 54.

Figure 4:
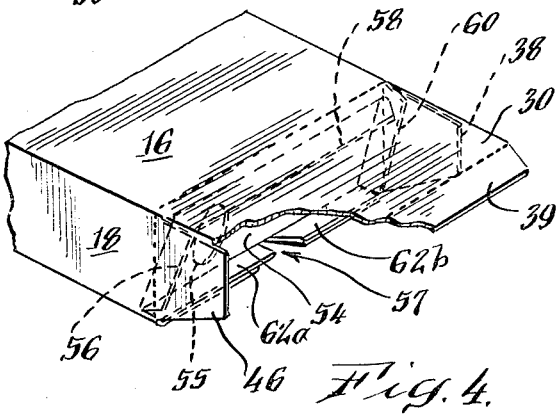
Figure 5:
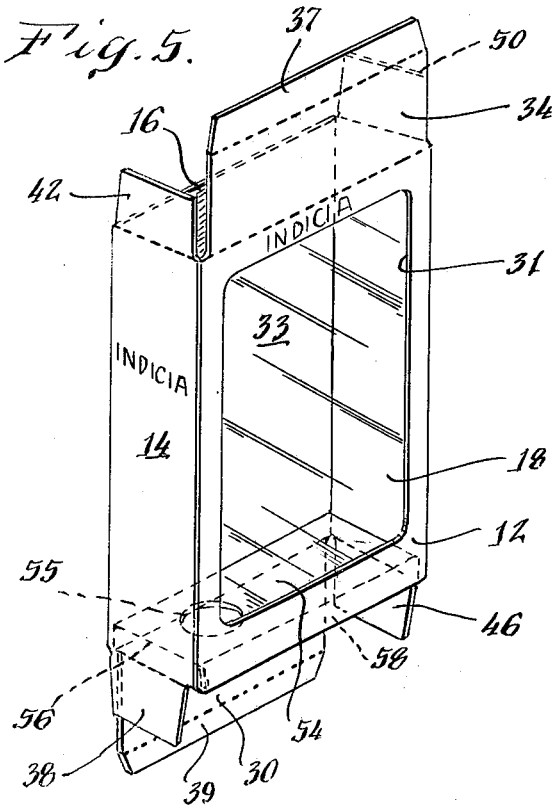

Referring now also to FIGS. 2–5, the first step in folding the blank 10 into an erected carton consists of folding the sidewall panels 12, 14, 16 and 18 about the corresponding fold lines 20, 22 and 24 into a tubular configuration, whereupon the glue flap 26 may be adhesively secured to the outer or inner face of sidewall panel 18. Platform panel 54 is rotated 180° about the fold line 80 in the direction of the arrows 59 in FIG. 2. Next, portions 62*a* and 62*b* along with connecting tab 72 are pivoted 180° about the fold line 73 until portions 62*a* and 62*b* are disposed in overlying abutting relationship to the interior face of sidewall panel 12 as shown in FIG. 4. Prior to or simultaneous with the preceding step, flap members 56, 58 and 60 are folded downwardly about the corresponding fold lines 64, 66 and 68 and platform panel 54 is pivoted 90° along fold line 70 to an essentially horizontal position, in perpendicular relationship to the sidewall panel 12. At this point, it may be appreciated that one face of the flap member 62 is disposed in side-by-side, abutting relationship to the interior face of sidewall panel 12 and the triangularly shaped connecting tab 72 is interposed between portion 62*a* and the interior face of sidewall panel 12. It is further apparent that a pair of adjacent edges of the connecting tab 72, namely those edges defined by fold lines 73 and 80 are respectively hingedly connected with one edge of the sidewall panel 12, and with the flap member 62. Upon rotation of the platform member 54, a triangularly shaped cut-out 57 is formed in the flap member 62 which corresponds in geometrical configuration to the connecting tab 72. Preferably, connecting tab 72 will possess the shape of a right triangle wherein fold lines 73 and 80 extend perpendicular to each other.

Upon folding and rotating the platform panel 54 as described above it may be appreciated that the indicia 61 on one face of such platform panel 54 is disposed upwardly within the carton in opposition to the end of the carton containing the closure flaps 34, 42 and 50. The next step in folding the blank 10 comprises the step of rotating the closure flaps 38 and 46 about their corresponding fold lines 40 and 48 inwardly into overlying, spaced relationship to the platform panel 54, followed by the rotation of closure flap 30 about fold line 32 into overlapping abutting relationship to closure flaps 38 and 46, thereby closing the bottom or lower end of the carton. Closure flap 30 may be secured in the closed position thereof by folding and inserting the locking flap 39 into the interior of the carton. A product 71 may then be inserted into the carton and placed on the upper surface of platform panel 54 which carrys the indicia 61 thereon. Alternatively, the product 71 may be inserted into the cut-out 55 in order to hold and thereby stabilize the product 71 within the carton. The upper end of the carton may then be closed by rotating the closure flaps 42 and 50 about their corresponding fold lines 44 and 52, followed by the folding of closure flap 34 and insertion of locking flap 37 into the carton.

Figure 6:
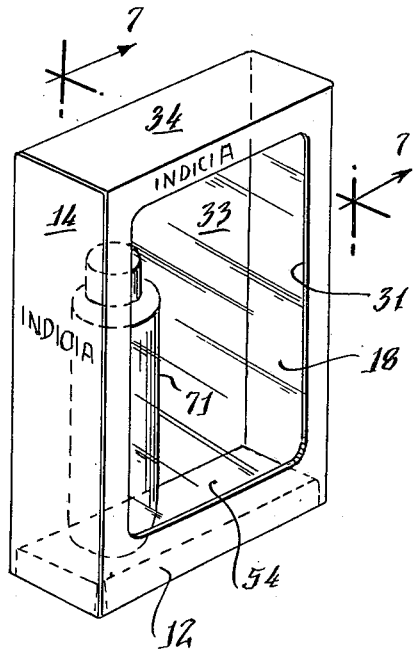
FIG. 6 is a perspective view of the erected carton which forms another aspect of the present invention.
Figure 7:
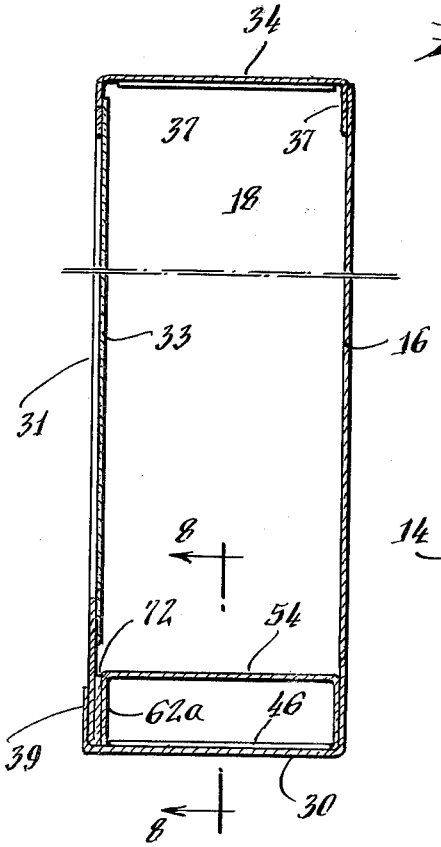
FIG. 7 is a sectional view taken along the line 7—7 in FIG. 6.
Figure 8:
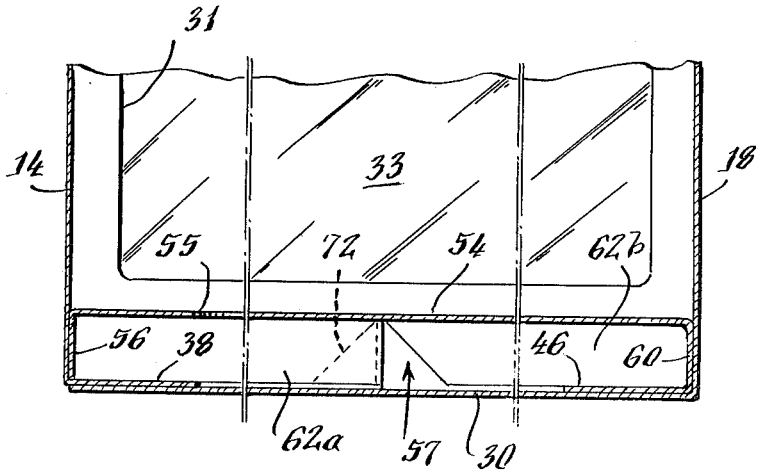
FIG. 8 is a sectional view taken along the line 8—8 in FIG. 7.

As shown in FIG. 6, the platform panel 54 forms a platform-like surface in the erected carton which may be viewed through the opening 31 in sidewall panel 16. The platform panel 54 is spaced slightly above the actual bottom of the carton defined by closure flap 30. Platform panel 54 is held in spaced relationship to closure flap 30 by means of flap members 56, 58, 60 and 62 which extend downwardly into contact with the upper surface of closure flaps 30, 38 and 46. The flap members 56, 58, 60 and 62 may be secured, if desired, by adhesive or the like applied between such flap members the interior surfaces of the corresponding sidewall panels 12, 14, 16 and 18, thereby assuring that the platform panel 54 will be held in fixed relationship within the carton.

From the foregoing, it may be readily appreciated that the novel blank and carton of the present invention necessitate the printing of indicia on only one face of a blank, which when folded, presents such indicia on the exterior faces of the sidewalls as well as on the upper, exposed surface of the platform within the carton. It is recognized, however, that those skilled in the art may make various modifications or additions to the preferred embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

What is claimed is:

1. A carton comprising:

a plurality of sidewalls joined together along mutual edges thereof to form a tube;

a bottom wall joined along a bottom edge of at least certain of said sidewalls and enclosing one end of said tube;

a platform within said tube and spaced above said bottom wall, said platform including a flap member hingedly connected thereto and extending downwardly toward said bottom wall, one face of said flap member being disposed in side-by-side abutting relationship to one of said sidewalls; and means for interconnecting said flap member with said one sidewall comprising a tab disposed in side-by-side overlapping relationship with the other face of said flap member, said tab having a pair of adjacent edges thereof respectively hingedly connected with a lower edge of said one sidewall and with said flap member.

2. The carton of claim 1 wherein said tab is triangular in shape.

3. The carton of claim 1 wherein said edges of said pair thereof extend essentially perpendicular to each other.

4. The carton of claim 1 wherein:

said flap member is essentially rectangular in shape, and one of said edges of said pair thereof of said tab extends between one pair of opposing edges of said flap member.

5. The carton of claim 1 wherein said flap member includes a cut-out section therein adjacent said tab having a geometry corresponding to the geometry of said tab.

6. A blank comprising a single sheet of paper stock for forming a carton, comprising:

first, second and third generally rectangular panels disposed in side-by-side relationship to each other, said first and second panel being interconnected by a first fold line extending along mutual edges thereof, said second and third panels being interconnected by a second fold line extending generally parallel to said first fold line, said second and third panels having therebetween first and second cut lines in said paper stock on respective opposite sides of said second fold line, said cut lines being in parallel with said second fold line, a third fold line extending from one end of said second fold line and essentially normal to said first and second fold lines, and a third cut line extending between one end of said second cut line and one end of said third fold line distal from said second fold line.

7. The blank of claim 6 wherein said first and second cut lines, and said second fold line are aligned in a single path and define one edge of said third panel.

8. The blank of claim 6, including a tab having a generally triangular shape, said tab having the edges thereof defined by said second and third fold lines and by said third cut line.

* * * * *